US012305664B2

(12) United States Patent
Talaber et al.

(10) Patent No.: US 12,305,664 B2
(45) Date of Patent: May 20, 2025

(54) FAN MOUNTING SYSTEM

(71) Applicant: The GSI Group, LLC, Assumption, IL (US)

(72) Inventors: Laszlo Talaber, Budapest (HU); Joshua Sander, Assumption, IL (US); Brian Daniel Duke, Assumption, IL (US)

(73) Assignee: The GSI Group, LLC, Assumption, IL (US)

( * ) Notice: Subject to any disclaimer, the term of this patent is extended or adjusted under 35 U.S.C. 154(b) by 0 days.

(21) Appl. No.: 18/884,955

(22) Filed: Sep. 13, 2024

(65) Prior Publication Data

US 2025/0122884 A1 Apr. 17, 2025

Related U.S. Application Data

(60) Provisional application No. 63/590,542, filed on Oct. 16, 2023.

(51) Int. Cl.

| | |
|---|---|
| ***F04D 29/34*** | (2006.01) |
| ***F04D 19/00*** | (2006.01) |
| ***F04D 29/32*** | (2006.01) |
| ***F04D 29/52*** | (2006.01) |

(52) U.S. Cl.

CPC ..... *F04D 29/34* (2013.01); *F04D 19/002* (2013.01); *F04D 29/325* (2013.01); *F04D 29/522* (2013.01)

(58) Field of Classification Search

CPC ..... F04D 29/34; F04D 19/002; F04D 29/325; F04D 29/522; F04D 25/12; F04D 29/60; F04D 29/602; F04D 29/646

See application file for complete search history.

(56) References Cited

U.S. PATENT DOCUMENTS

2021/0102729 A1* 4/2021 Baljekar ..... F16M 13/02

FOREIGN PATENT DOCUMENTS

| | | |
|---|---|---|
| CN | 214465003 U | 10/2021 |
| EP | 3044393 B1 | 11/2020 |

OTHER PUBLICATIONS

UK Intellectual Property Office, Search Report for related UK Application No. GB2319569.6, dated Jun. 4, 2024, 3 pages.

* cited by examiner

*Primary Examiner* — Aaron R Eastman

(74) *Attorney, Agent, or Firm* — RAY QUINNEY & NEBEKER; Daniel J. Bezdjian

(57) ABSTRACT

A fan assembly has a propeller and a housing that forms a fan shroud. A propeller mount assembly mounts the propeller to the housing and positions the propeller concentric within the fan shroud. A mounting bar is connected to the housing with mounting brackets. Each mounting bracket has a body that interfaces with the mounting bar and at least one wing that interfaces with the housing, where the body has at least one elongated body slot with a body slot axis that aligns with a bar hole in the mounting bar. Each wing has a wing slot a wing slot axis that aligns with a housing hole in the housing. A body fastener is configured to secure the mounting bar to the mounting bracket and a wing fastener is configured to secure the mounting bracket to the housing.

7 Claims, 4 Drawing Sheets

FIG. 3

FAN MOUNTING SYSTEM

CROSS-REFERENCE TO RELATED APPLICATIONS

This application claims the benefit of the filing date of U.S. Provisional Patent Application 63/590,542, "Fan Mounting System," filed Oct. 16, 2023, the entire disclosure of which is incorporated herein by reference.

BACKGROUND OF THE INVENTION

Field of Invention

This invention relates to mounting systems in ventilation systems for animal buildings, and more particularly a fan assembly having a mounting system used to aid in the installation of a propeller in a fan shroud.

Description of Related Art

Achieving optimal performance from animals raised in commercial animal house buildings (such as poultry or swine houses) depends in part on providing ventilation as correctly and efficiently as possible. Proper ventilation improves overall over air quality, stabilizes air temperatures, and reduces energy consumption. Improper ventilation levels can lead to incorrect moisture levels, unsuitable temperatures, poor air quality, increased animal mortality, and in some instances lead to catastrophic fire situations endangering the animals and the employees at these facilities.

Ventilation fans are often used as part of the ventilation system for animal houses. The ventilation fans have a propeller with a number of fan blades driven by a power source. The fan usually has a fan shroud used to focus airflow around the propeller. To improve the performance of the ventilation fan, it is desirable that the clearance between the propeller tips and the inside diameter of shroud be small and consistent.

However, it is known that manufacturing tolerances result in variations of the components used to make propellers and shrouds. These manufacturing tolerance variations can affect the function of the fan. For example, variations can cause the propeller to be mounted slightly offset in the shroud (i.e., not centered). Any rubbing of the propeller on the fan shroud could cause failures in the fan, safety issues, and decreased fan performance. These failures could even be dangerous to people or animals around the fan. Therefore, tolerances in the manufacturing of the components of fan assemblies have meant that the designed tip clearances needed to be increased to insure the propeller and shroud could be assembled without contact, negatively affecting the efficiency of the fan.

BRIEF SUMMARY

In one aspect, the invention is directed to a fan assembly having a propeller with a plurality of fan blades attached to a fan shaft. The fan assembly has a fan power system causing rotation of the propeller and a housing that forms a circular fan shroud, with the propeller received in the fan shroud. The fan assembly has a propeller mount assembly configured to mount the propeller to the housing and position the propeller within the fan shroud such that the propeller is concentric with the fan shroud. The propeller mount assembly includes a mounting bar, where the propeller is mounted on a center portion of the mounting bar. The propeller mount assembly also includes a pair of mounting brackets, where the mounting bar is connected to the housing with one mounting bracket of the pair of mounting brackets at each end of the mounting bar. Each mounting bracket has a body that interfaces with the mounting bar and at least one wing that interfaces with the housing, where the body has at least one elongated body slot that aligns with a bar hole in the mounting bar. The elongated body slot has a body slot axis that allows relative movement of the mounting bar with respect to the mounting bracket while aligned with the bar hole. Each wing has a wing slot that aligns with a housing hole in the housing. The wing slot has a wing slot axis that allows for relative movement of each wing of the mounting bracket with respect to the housing while aligned with the housing hole. At least one body fastener is configured to secure the mounting bar to the mounting bracket using the body slot and bar hole. At least one wing fastener is configured to secure the mounting bracket to the housing. The wing slot axis is perpendicular to the body slot axis.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
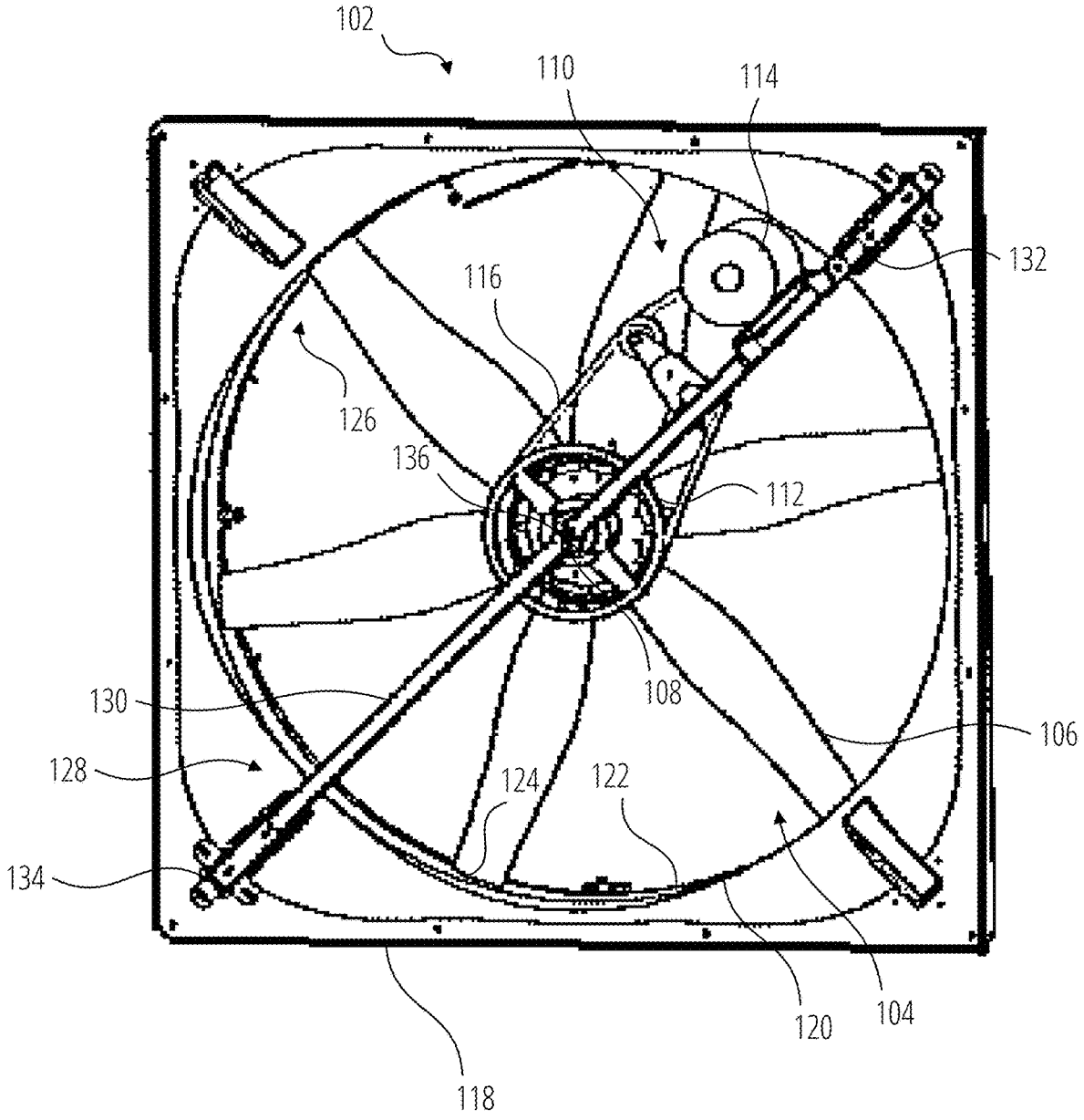
FIG. 1 illustrates a fan assembly in accordance with one embodiment.

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description. Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right" are used as a matter of mere convenience and are determined by standing at the rear of the machine facing in its normal direction of travel. Furthermore, the various components shown or described herein for any specific application of this invention can be varied or altered as anticipated by this invention and the practice of a specific application of any element may already by widely known or used in the art by persons skilled in the art and each will likewise not therefore be discussed in significant detail.

As used herein, the singular forms following "a," "an," and "the" are intended to include the plural forms as well, unless the context clearly indicates otherwise. As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded. As used herein, the term "configured" refers to a size, shape, material composition, and arrangement of one or more of at least one structure and at least one apparatus facilitating operation of one or more of the structure and the apparatus in a predetermined way.

As used herein, any relational term, such as "first," "second," "top," "bottom," "upper," "lower," "above," "beneath," "side," etc., is used for clarity and convenience in understanding the disclosure and accompanying drawings, and does not connote or depend on any specific preference or order, except where the context clearly indicates otherwise.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.). As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

FIG. 1 illustrates a fan assembly 102 such as one installed in a portion of a sidewall of an animal house. The fan assembly 102 includes a propeller 104 having a number of fan blades 106 attached to a fan shaft 108. The fan assembly 102 also has a fan power system 110 including a driven sheave 112 on the fan shaft 108 connected to a motive force 114 with a belt 116 such that the motive force 114 causes rotation of the propeller 104. The propeller 104 and fan power system 110 of the fan assembly 102 may be of any suitable design known to one skilled in the art and need not be discussed in further detail herein.

The fan assembly 102 has a housing 118 that forms a circular fan shroud 120, with the propeller 104 received concentrically in the fan shroud 120. Rotation of the propeller 104 creates a focused airflow channel through the housing 118. The fan shroud 120 has a smooth inner surface 122 facing the propeller 104. The propeller 104 is desirably centered in the housing 118 such that outer tips 124 of the fan blades 106 come close to but do not contact the inner surface 122 of the fan shroud 120 such that there is a small tip clearance 126 around the circumference of the rotating propeller 104.

To improve the performance of the fan assembly 102, it is desirable that the tip clearance 126 be as small as practicable. However, it is known that manufacturing tolerances result in variations in the components used for propellers and shrouds. These variations can affect the function of the fan. For example, variations can cause the propeller to be mounted slightly offset in the shroud. Any rubbing of the propeller on the fan shroud could cause failures in the fan assembly. Therefore, tolerances in the manufacturing of the components of fan assemblies have historically meant that the designed tip clearances needed to be increased to insure the propeller and shroud could be assembled without contact. These larger tip clearances negatively affect the efficiency and power consumption of the fan.

Figure 2:
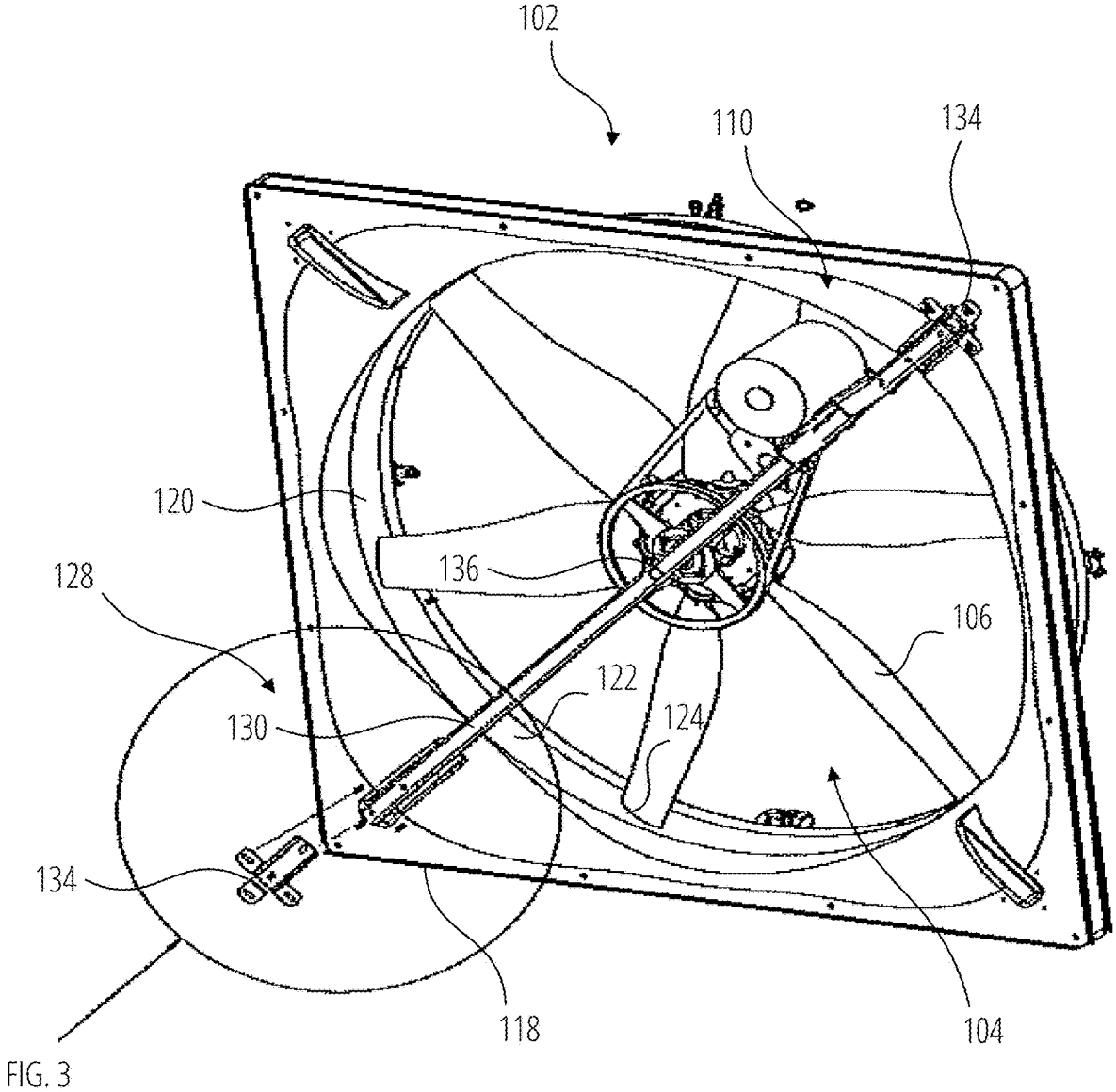
FIG. 2 illustrates a partially exploded perspective view of the fan assembly of FIG. 1.

According to the invention, the propeller 104 is mounted to the housing 118 and positionable within the fan shroud 120 with a propeller mount assembly 128. The propeller mount assembly 128 includes a mounting bar (e.g., post or other suitable propeller-mounting structure) 130 that is received at either end in channels or pockets 132 formed in the housing 118. The mounting bar 130 is connected to the housing 118 with mounting brackets 134, with one mounting bracket 134 at opposite ends of the mounting bar 130 as perhaps best seen in the exploded view of FIG. 2. The propeller 104 is mounted on a center portion 136 of the mounting bar 130, and the mounting bar 130 is positioned such that the propeller 104 is concentric with the fan shroud 120.

Figure 3:
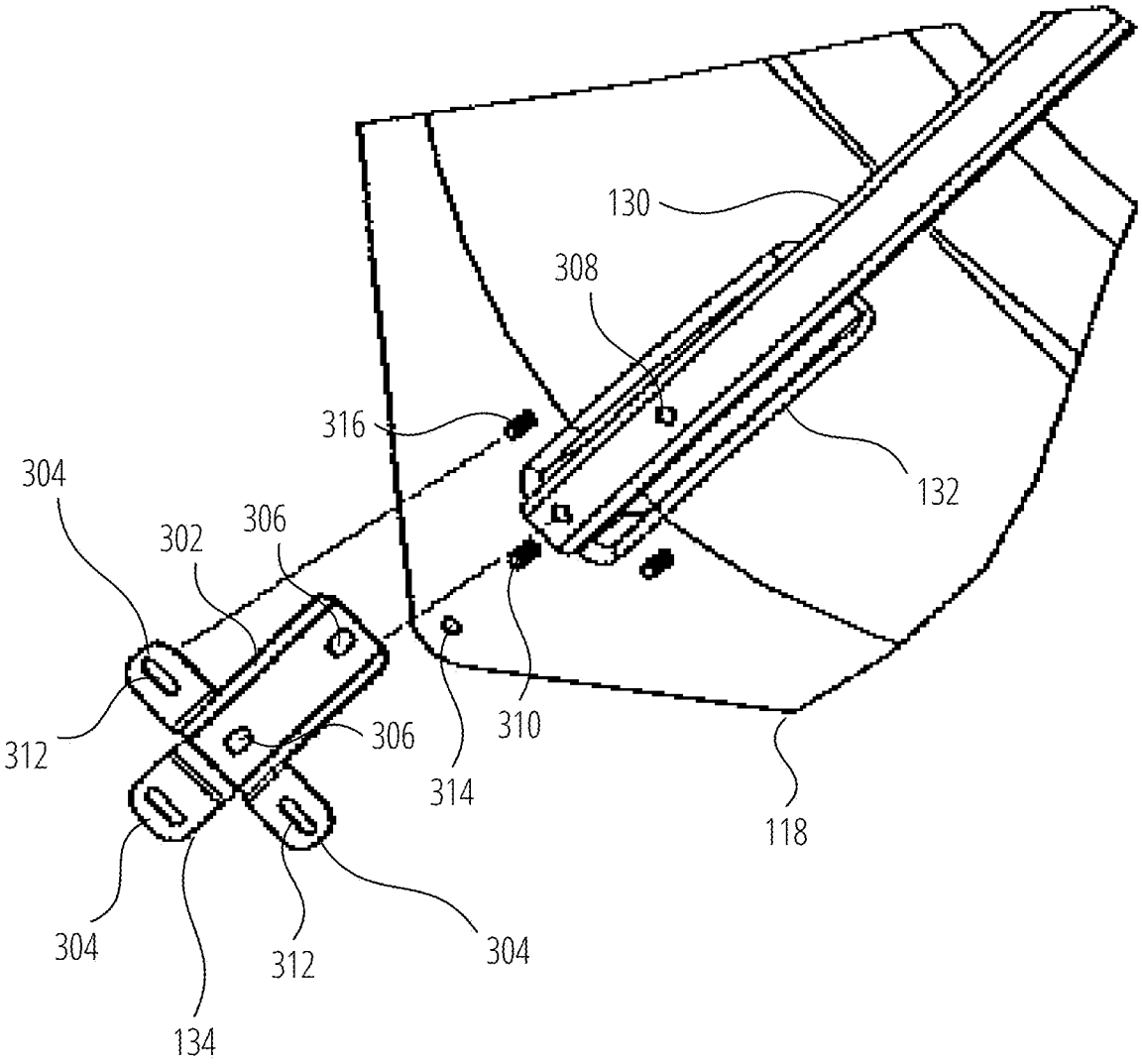
FIG. 3 illustrates an enlarged portion of FIG. 2 showing an exploded perspective view of a portion of the fan assembly.
Figure 4:
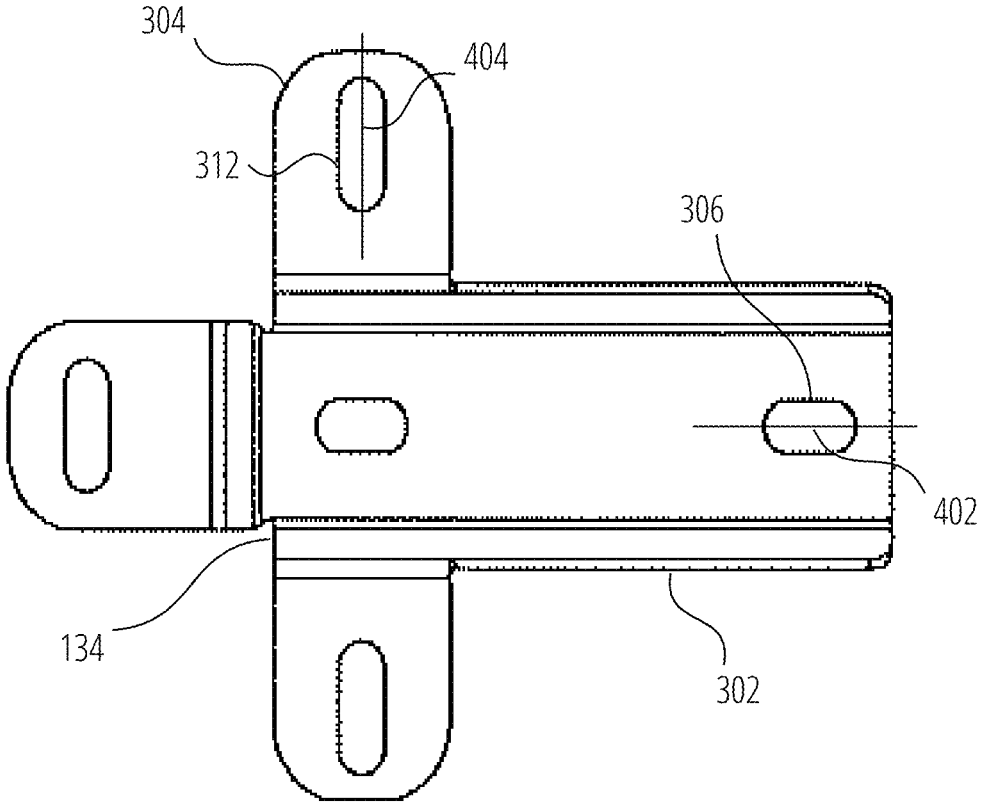
FIG. 4 illustrates a plan view of a mounting bracket of the fan assembly of FIG. 1.

Turning also now to FIG. 3, each mounting bracket 134 has a body 302 that interfaces with the mounting bar 130 and at least one wing 304 that interfaces with the housing 118. The body 302 has at least one elongated body slot 306 that aligns with a bar hole 308 in the mounting bar 130. A body fastener 310 is used to secure the mounting bar 130 to the mounting bracket 134 using the body slot 306 and bar hole 308. The body fastener 310 is desirably a suitable bolt and nut combination, but other known fasteners may be used. As best seen in FIG. 4, the elongated body slot 306 has a body slot axis 402 that allows some relative movement of the mounting bar 130 with respect to the mounting bracket 134 while remaining aligned with the bar hole 308 before the body fastener 310 is tightened to securely fasten the mounting bar 130 to the mounting bracket 134. The number of body slots 306 and corresponding mounting bar holes 308 is dependent on the size of the propeller 104 and the forces that needs to be accounted for in order to hold the propeller 104 in place. In the illustrated embodiment, the mounting bracket 134 has two body slots 306. The body slot axes 402 for each of the body slots 306 are parallel thus enabling the mounting bar 130 to move along body 302 in the channel 132 in the direction of the body slot axes 402 with respect to the mounting bracket 134 before the body fasteners 310 are tightened. Tightening the body fasteners 310 desirably prevents further relative motion between the mounting bar 130 and the mounting bracket 134.

Each wing 304 on the mounting brackets 134 has a wing slot 312 that aligns with a housing hole 314 in the housing 118. A wing fastener 316 is used to secure the mounting bracket 134 to the housing 118. As best seen in FIG. 4, the wing slot 312 has a wing slot axis 404 that allows for some relative movement of the mounting bracket 134 with respect to the housing 118 before the wing fastener 316 is tightened to securely fasten the mounting bracket 134 to the housing 118. The number and location of the wing slots 312 and corresponding housing holes 314 is dependent on the size of the propeller 104 and the forces that needs to be accounted for in order to hold the propeller 104 in place. In the illustrated embodiment, the mounting bracket 134 has three wings 304. The wing slot axes 404 for each of the wing slots 312 are parallel enabling the mounting bracket 134 to move along the direction of the wing slot axes 404 with respect to the housing 118 before the wing fasteners 316 are tightened. Tightening the wing fasteners 316 desirably prevents further relative motion between the mounting bracket 134 and the housing 118.

The wing slot axes 404 are perpendicular to the body slot axes 402. With the wing slots 312 and the body slots 306 perpendicular, and before the wing fasteners 316 and body fasteners 310 are completely tightened, the mounting bracket 134 may be moved relative to the housing 118 and the mounting bar 130 may be moved relative to the mounting bracket 134 so that together they enable an operator assembling the fan assembly 102 to move the propeller 104 in directions on both the x and y axes so as to precisely position the center portion 136 of the mounting bar 130 and the propeller 104 mounted thereon within the fan shroud 120 so that the outer tips 124 of the fan blades 106 come close to but do not contact the inner surface 122 of the fan shroud 120. Having the fan assembly 102 have a minimal tip clearance 126 between the inner surface 122 of the fan shroud 120 and the outer tips 124 of the propeller circumference which leads to better performance of the fan assembly 102. The propeller mount assembly 128 desirably enables the propeller 104 to move in any direction within the fan shroud 120 while only requiring a single mounting bar 130 that is connected with just a two-point connection with the pair of mounting brackets 13.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings.

What is claimed is:

1. A fan assembly having a propeller with a plurality of fan blades attached to a fan shaft, the fan assembly having a fan power system causing rotation of the propeller and a housing that forms a circular fan shroud, with the propeller received in the fan shroud, the fan assembly having a propeller mount assembly configured to mount the propeller to the housing and position the propeller within the fan shroud such that the propeller is concentric with the fan shroud, the propeller mount assembly comprising:

a mounting bar, wherein the propeller is mounted on a center portion of the mounting bar, a pair of mounting brackets, wherein the mounting bar is connected to the housing with one mounting bracket of the pair of mounting brackets at each end of the mounting bar, wherein each mounting bracket has a body that interfaces with the mounting bar and at least one wing that interfaces with the housing, wherein the body has at least one elongated body slot that aligns with a bar hole in the mounting bar, the elongated body slot having a body slot axis that allows relative movement of the mounting bar with respect to the mounting bracket while aligned with the bar hole, wherein each wing has a wing slot that aligns with a housing hole in the housing, the wing slot having a wing slot axis that allows for relative movement of the wing of the mounting bracket with respect to the housing while aligned with the housing hole;

at least one body fastener configured to secure the mounting bar to the mounting bracket using the body slot and bar hole; and at least one wing fastener configured to secure the mounting bracket to the housing;

wherein the wing slot axis is perpendicular to the body slot axis.

2. The fan assembly of claim 1 wherein tightening the body fasteners prevents relative motion between the mounting bar and the mounting bracket.

3. The fan assembly of claim 1 wherein tightening the wing fasteners prevents relative motion between the mounting bracket and the housing.

4. The fan assembly of claim 3 wherein when the wing fasteners are not tight, the mounting bracket may be moved relative to the housing and the mounting bar may be moved relative to the mounting bracket so that the propeller may be precisely positioned within the fan shroud in directions along both the x and y axes.

5. The fan assembly of claim 1 wherein the mounting bar is received in channels formed in the housing, wherein the propeller mount assembly enables the mounting bar to slide in the channels.

6. The fan assembly of claim 5 wherein the mounting bracket has two body slots and the body slot axis for each of the body slots are parallel thus enabling the mounting bar to move along the body in the channels along the direction of the body slot axes with respect to the mounting bracket and body slots before the body fasteners are tightened.

7. The fan assembly of claim 1 wherein the mounting bracket has three wings and the wing slot axis for each of the wing slots are parallel enabling the mounting bracket to move along the direction of the wing slot axes with respect to the housing before the wing fasteners are tightened.

* * * * *